United States Patent [19]

Diez

[11] 4,061,182

[45] Dec. 6, 1977

[54] LOW-PRESSURE CASTING APPARATUS

[75] Inventor: Adolf Diez, Bad Friedrichshall II, Germany

[73] Assignee: Karl Schmidt GmbH, Neckarsulm, Germany

[21] Appl. No.: 709,997

[22] Filed: July 30, 1976

Related U.S. Application Data

[63] Continuation of Ser. No. 559,474, March 18, 1975, abandoned.

[30] Foreign Application Priority Data

Apr. 8, 1974 Germany ..... 2417102

[51] Int. Cl.[2] ..... B22D 17/02; B22D 17/26

[52] U.S. Cl. ..... 164/309; 164/343

[58] Field of Search ..... 164/306, 309, 331, 339, 164/340, 345, 136, 137, 343

[56] References Cited

U.S. PATENT DOCUMENTS

| | | | |
|---|---|---|---|
| 3,168,765 | 2/1965 | Bernhardt | 164/340 X |
| 3,757,850 | 9/1973 | Diez et al. | 164/309 |

FOREIGN PATENT DOCUMENTS

| | | | |
|---|---|---|---|
| 1,927,804 | 10/1970 | Germany | 164/309 |

*Primary Examiner*—Francis S. Husar
*Assistant Examiner*—Gus T. Hampilos
*Attorney, Agent, or Firm*—Burgess, Dinklage & Sprung

[57] ABSTRACT

Low-pressure casting apparatus is disclosed and includes a holding furnace having a cover, an ingot mold positioned on top of the furnace cover, a riser pipe connecting the holding furnace with the interior of the mold, upright tension rods to vertically move the cover plate of the mold, two opposite, upright flat members attached to rear portions of the sidewalls of the holding furnace, a horizontal bridge structure mounted between the flat upright members and having a U-shaped slot in which is horizontally slidably mounted a tension element, and means to horizontally move the tension element. The apparatus is improved by brackets vertically adjustably mounted on the upright flat members with the bridge structure being pivotably mounted between the brackets.

1 Claim, 2 Drawing Figures

LOW-PRESSURE CASTING APPARATUS

This is a continuation of application Ser. No. 559,474, filed Mar. 18, 1975 now abandoned.

BACKGROUND

This invention relates to low-pressure casting apparatus of the type described in U.S. Pat. No. 3,757,850. A holding furnace is adapted to be closed gas-tightly, to be supplied with a compressed gas and to hold a metal bath. A riser pipe immersed in the bath connects the furnace to the base plate of a permanent mold which consists of stationary or fixed mold parts. The mold is adapted to be closed at it top by a core cover plate which carries on its underside the core affixed thereto. The cover plate is vertically movable by means of a plurality of hydraulically operated tension columns. The casting apparatus also includes two opposed flat vertical beams which are attached to rear portions of the sides of the holding furnace housing. The furnace is closed by a cover which carries the base plate of the permanent mold. A horizontal bridge structure, which has a forwardly opening, U-shaped recess is mounted between the vertical beams and includes forwardly and rearwardly projecting arms. A horizontally movably, hydraulically operated tension element is mounted in the U-shaped recess and serves to operate tension columns, as described and shown in U.S. Pat. No. 3,757,850.

This low-pressure casting apparatus affords a number of important advantages. For instance, the stroke length of the tension columns can be adjusted by a simple and fast operation to the overall height of the parts of the permanent mold because the bridge structure is vertically movably mounted on the vertical beams. Besides, the attachment of the vertical beams to the rear portion of the sides of the holding furnace housing and the U-shaped recesses in the bridge structure allow installation of the parts of the permanent molds, and replacement of the riser pipe in a vertical direction from above, in a simple operation without substantial physical effort and without having to remove mold attaching devices from the holding furnace.

The tension element which is horizontally movably mounted in the U-shaped recess of the bridge structure makes it possible to drop castings suspended from the core cover plate directly onto handling means positioned between the flat beams, e.g., a chute, so that it is no longer necessary for the operator to remove the casting from the core cover plate and to deposit it in a handling container.

According to an additional feature of the low-pressure casting apparatus, the brackets holding the bridge structure are clamped to the flat beams by a plurality of clamp screws when the apparatus is in operation. If a change in the parts of the permanent mold requires a change of the length of the stroke of the tension columns, the clamp screws are loosened. Thus, the bridge structure is held in position on the flat beams by clamping bars, which act on the rear edges of the flat beams under a certain spring pressure, the clamping bars being connected to the bridge structure by the spring.

SUMMARY

It has now been found that such a low-pressure casting apparatus can be further improved if, in accordance with the invention, the bridge structure is pivoted between brackets which are vertically adjustably mounted, e.g., clamped, on the flat vertical beams.

The bridge structure is preferably pivoted between forward portions of each of the brackets on a pivot pin mounted therein. Thus, the improved low-pressure casting apparatus of the invention includes

- holding furnace means for a molten metal bath, said furnace means having cover means and being adapted to be closed gas tight and supplied with gas under pressure;
- ingot mold means positioned on top of said furnace means and including base plate means caeried by the cover means of said furnace means and core cover plate means having attached to the underside thereof core means;
- riser pipe means adapted to be immersed in said metal bath and communicating with the base plate means of the ingot mold means;
- a plurality of upright tension rods adapted to vertically move the core cover plate means of said ingot mold;
- two opposite, upright flat members positioned to the rear of the sidewalls of said furnace means;
- horizontal bridge means mounted between said upright flat members;
- said bridge means having a U-shaped slot in which is horizontally slidably mounted tension means, and said bridge means having means to horizontally move said tension means.

The improvement over the apparatus of U.S. Pat. No. 3,757,850 involves bracket means vertically adjustably mounted on said upright flat members, said bridge means being pivotally mounted between said bracket means.

DESCRIPTION OF THE DRAWING

The invention is shown by way of example in the drawing and will be explained more fully hereinafter.

DESCRIPTION

Figure 1:
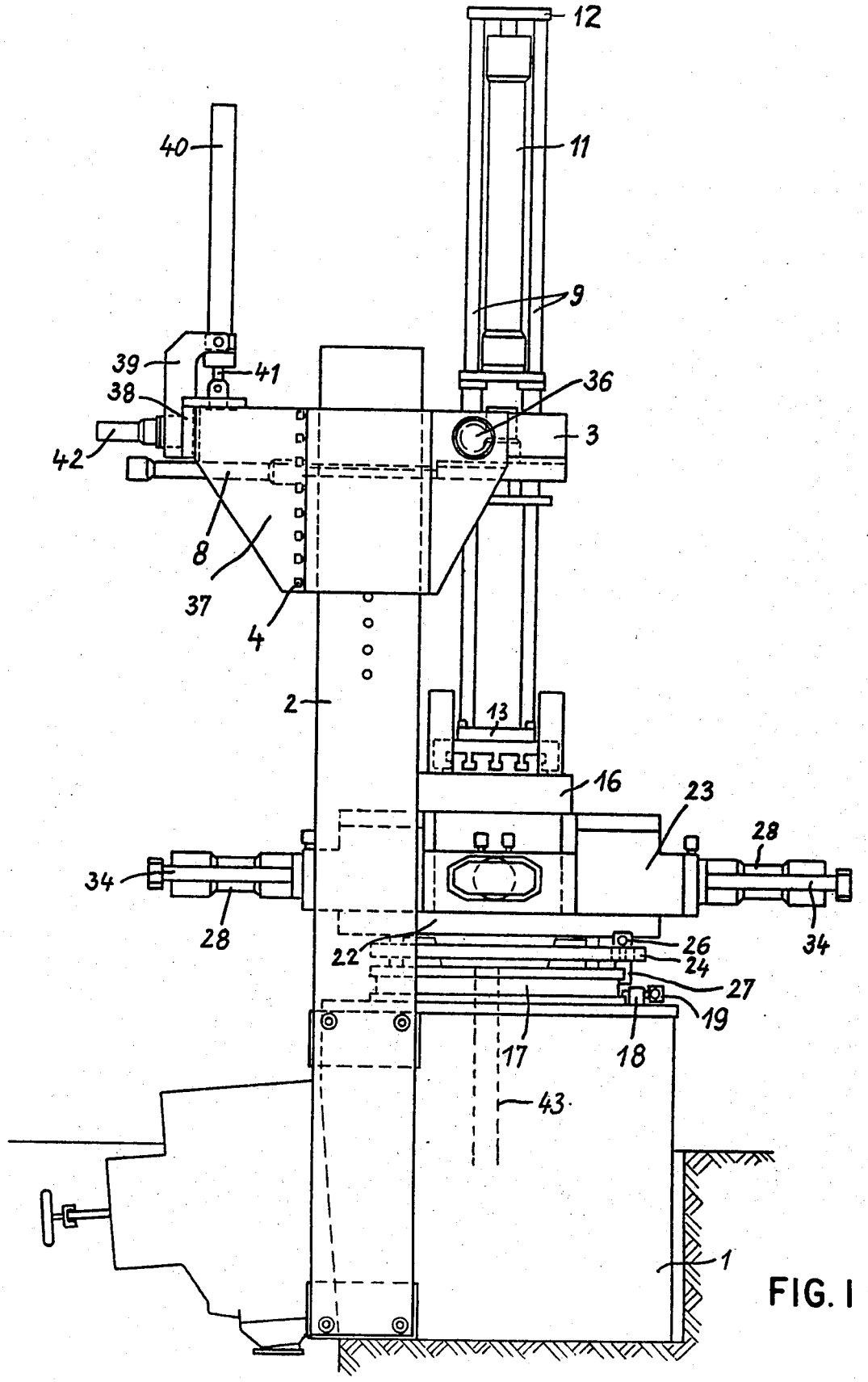
FIG. 1 is a side elevational view showing the low-pressure casting apparatus in an operative position.

The upper part of the permanent mold can be pivotally moved to an outwardly and upwardly inclined position so that the upper part of the permanent mold is readily accessible and residual metal can be removed and small repairs and other operations can be performed in a simple manner.

The pivotal movement is imparted by an actuating device, connected to the bridge structure adjacent the rear portion thereof. The actuating device is preferably a hydraulic actuator which is pivoted at its lower end in a bearing bracket mounted on a cross-beam which connects the brackets of the bridge structure.

The bridge structure is adapted to be locked in the operative position by a locking device mounted in the cross-beam. The locking device is preferably hydraulically operated.

Referring now to the drawing, a pivot pin 36 is mounted between brackets 37, which are attached to flat, vertical beams 2. A bridge structure 3 is mounted in the forward portion of the brackets 37 on pivot pin 36 so that the bridge structure can be pivoted forwardly and upwardly (FIG. 2). Adjacent to their rear end, the brackets 37 are interconnected by a cross-beam 38. The latter carries a bearing bracket 39 in which a hydraulic actuator 40 is pivotally mounted adjacent its lower end. The piston rod 41 of the actuator 40 is pivotally connected to the rear portion of the bridge structure 3. A hydraulically operated locking element 42 is mounted in the cross-beam 38 and operates to lock the bridge structure 3 in its operative position as shown in FIG. 1.

Figure 2:
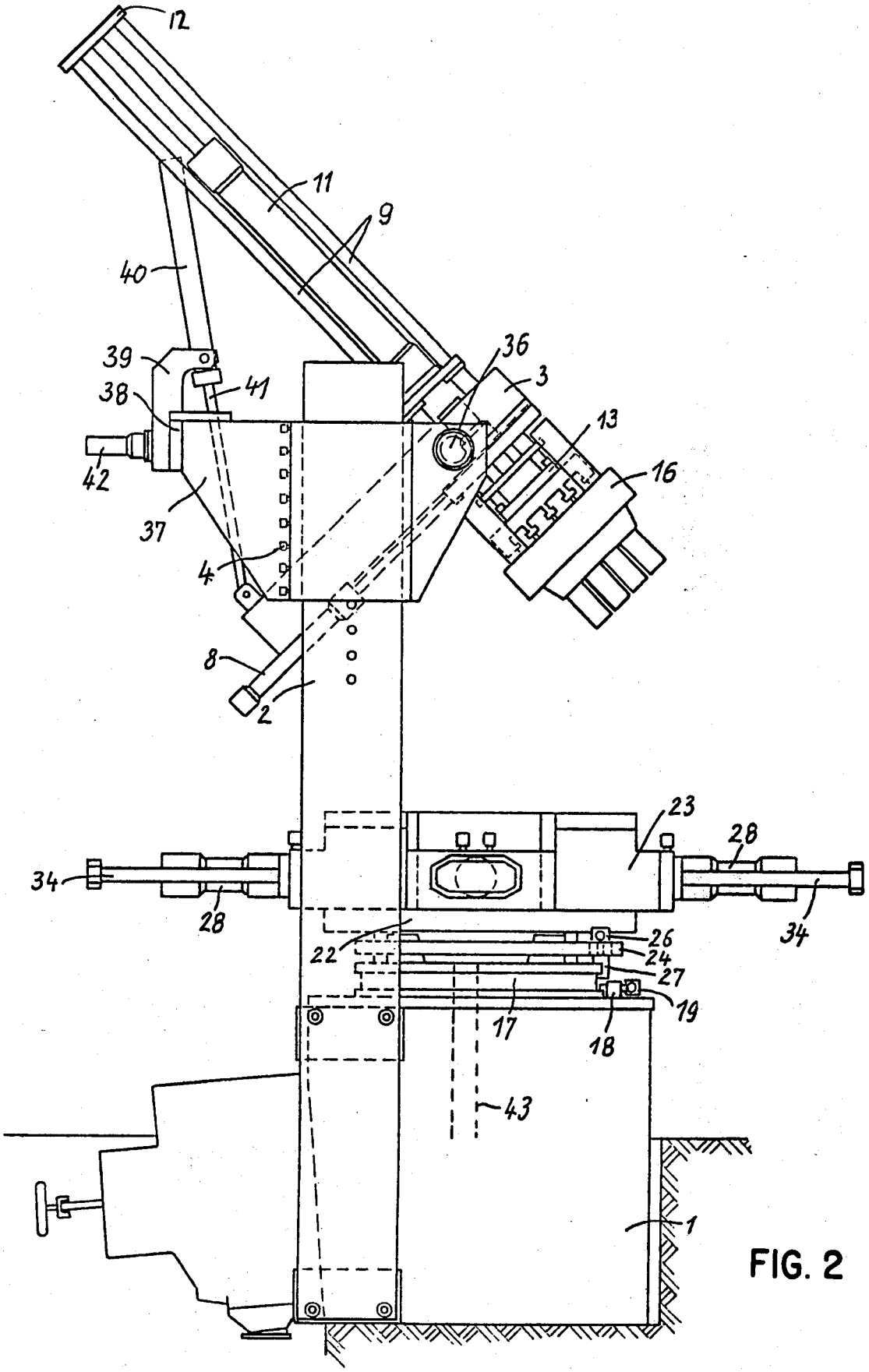
FIG. 2 is a side elevational view showing the apparatus in a swung-out or pivoted position.

Referring further to FIGS. 1 and 2, the two vertically flat beams 2 are secured to the rear end of the side parts of the holding furnace 1 for a metal bath. The bridge structure 3 is connected to the top end of the beams 2 and has protruding arms at its rear and forward ends and is secured by clamping screws 4 to the beams 2. Also provided is hydraulic actuator 8 and tension columns 9. An abutment 12 is connected to the upper end of the tension columns 9 and to the hydraulic actuator 11 for the operation of the tension columns 9. The driver plate 13 is secured to the lower end of the four tension columns 9. The core cover plate 16 is secured to driver plate 13. The holding furnace 1 is closed by the furnace cover 17, which is secured horizontally slidable fixing elements, each of which consists essentially of the bearing bracket 18, which is secured to the edge of the holding furnace, the hollow eccentric pin 19 which is mounted in the bearing bracket 18.

The bottom base plate 22 of the ingot mold 23 is secured to the furnace cover 17 by clamping elements, which consist of clamping bar 24 which receives pins 26, which are connected to hook elements 27 which engage the underside of the top edge of the cover 17.

The mold parts of the ingot mold 23 are operated by hydraulic actuators 28.

Tension rods 34 are adapted to vertically move the cover plate 16 of the ingot mold 23.

Riser pipe 43 is adapted to be immersed in the metal bath and communicates with base plate 22.

Other component parts and the operation of the low-pressure casting operation are as described in said patent U.S. Pat. No. 3,757,850, which is incorporated herein by reference.

I claim:

1. In low-pressure casting apparatus which comprises holding furnace means for a molten metal bath, said furnace means having cover means and sidewalls and being adapted to be closed gas tight and supplied with gas under pressure;

ingot mold means positioned on top of said furnace means and including base plate means carried by the cover means of said furnace means and core cover plate means having attached to the underside thereof core means;

riser pipe means adapted to be immersed in said metal bath and communicating with the base plate means of the ingot mold means;

a plurality of upright tension rods adapted to vertically move the core cover plate means of said ingot mold;

two opposite, upright flat members positioned to the rear of the sidewalls of said furnace means;

horizontal bridge means mounted between said upright flat members;

said bridge means having a U-shaped slot in which is horizontally slidably mounted tension means, and said bridge means having means to horizontally move said tension means;

the improvement which comprises bracket means vertically adjustably mounted on said upright flat members, horizontal pivot pin means mounted on the forward portions of the bracket means, the bridge means being pivotally mounted on the pivot pin means for pivotal movement thereabout, a cross-beam connecting the bracket means and carrying a bearing bracket, a hydraulic actuator for the pivoting movement and pivoted in said bearing bracket, and means on said cross-beam for locking said bridge means in operative position.

* * * * *